US007942652B1

(12) United States Patent
Murray

(10) Patent No.: US 7,942,652 B1
(45) Date of Patent: May 17, 2011

(54) BI-DIRECTIONAL CENTRIPETALLY-POWERED RECIPROCATING PUMP

(76) Inventor: Lawrence D. Murray, Kingsland, GA (US)

( * ) Notice: Subject to any disclaimer, the term of this patent is extended or adjusted under 35 U.S.C. 154(b) by 66 days.

(21) Appl. No.: 12/626,920

(22) Filed: Nov. 29, 2009

Related U.S. Application Data

(60) Provisional application No. 61/118,597, filed on Nov. 29, 2008.

(51) Int. Cl.
*F04B 17/00* (2006.01)
*F04B 35/04* (2006.01)

(52) U.S. Cl. ..... 417/415; 417/419; 417/374; 417/328

(58) Field of Classification Search ..... 417/415, 417/419, 374, 328; 92/187
See application file for complete search history.

(56) References Cited

U.S. PATENT DOCUMENTS

| | | | | |
|---|---|---|---|---|
| 1,919,394 | A * | 7/1933 | Rosenkranz | 414/746.7 |
| 2,005,854 | A * | 6/1935 | Davis et al. | 425/513 |
| 2,085,355 | A * | 6/1937 | Greenwald | 417/371 |
| 2,760,384 | A * | 8/1956 | Chrisman | 74/600 |
| 4,526,032 | A * | 7/1985 | Huster | 73/245 |
| 5,088,902 | A * | 2/1992 | Marioni | 417/415 |
| 5,464,331 | A * | 11/1995 | Sawyer | 417/364 |
| 6,290,622 | B1 * | 9/2001 | Murray | 475/162 |
| 6,369,469 | B1 * | 4/2002 | Murray | 310/20 |
| 6,783,333 | B2 * | 8/2004 | Wang | 417/307 |

* cited by examiner

*Primary Examiner* — Charles G Freay
*Assistant Examiner* — Peter J Bertheaud
(74) *Attorney, Agent, or Firm* — Jonathan Rigdon Smith, PC; Jonathan R. Smith

(57) ABSTRACT

A reciprocating liquid or gas pump is driven by bi-directional force. A prime mover causes eccentric weights to rotate, which in turn cause pistons to be driven in linear paths under bi-directional force. This bi-directional force then drives opposing sets of pistons to pump a fluid. The pressurized fluid can then be used for, e.g., driving a hydraulic motor.

17 Claims, 4 Drawing Sheets

BI-DIRECTIONAL CENTRIPETALLY-POWERED RECIPROCATING PUMP

FIELD OF INVENTION

This invention is in the field of fluid pumps, more specifically in the field of mechanical pumps, and more specifically still in the field of positive displacement pumps. More specifically still, it is in the field of reciprocating pumps.

BACKGROUND OF INVENTION

The reciprocating pump is a specific type of positive displacement pump in which a constant and fixed volume of fluid is drawn into a cylinder by a retreating piston and then discharged under pressure. Its chief virtue compared with other types of positive displacement pumps such as vane, lobe, and screw pumps is that because of the good seal typically achievable between a piston and its cylinder wall, back-leakage of fluid around the piston is low compared to back-leakage of fluid in the other types. This is because a piston and its cylinder meet along a two-dimensional cylindrical surface, whereas a pump vane, screw, or lobe contacts its casing along a line. Thus, reciprocating pumps can deliver very high pressures with relatively high efficiency.

Typically the pistons in a reciprocating pump are driven by connecting rods that are in turn driven by a crankshaft. The connecting rods convert the rotational motion of the crankshaft into linear reciprocal motion of the piston. However, the connecting rods are only directly in line with the motion of the pistons at the top and bottom of the piston travel within the cylinder. Thus, along the rest of the path of the piston, the connecting rods are applying a sidewards force to the piston against the cylinder wall. This generates heat, wear, and pulsating stress on the pumping parts. The heat represents a loss of efficiency. These effects increase as the pressure rating of the pump is increased, that is, particularly in instances where such a pump is the pump of choice.

BRIEF DESCRIPTION AND OBJECTS OF INVENTION

A mechanical bi-directional centripetally-powered reciprocating liquid or gas pump is provided that converts a rotational force from an outside power source into a centripetal bi-directional force. The bi-directional force then drives opposing sets of pistons to pump liquid or gas. To achieve this the outside power source is applied to a gear train that powers right angle gearboxes. These gearboxes are paired to receive opposite rotations.

There is an additional pair of gearboxes and eccentrics rotating in the opposite direction to the first pair. As the gearboxes rotate the eccentrics, the two pairs of gearboxes oscillate toward and away from each other, thus providing force from opposite directions, i.e., bi-directionally. Each gearbox is attached to a straight shaft with a piston assembly attached to each end of the shaft. These piston assemblies are installed into cylinders that are attached to each end of the entire assembly unit. The cylinders are equipped with intake and discharge valves for positive displacement of fluid.

The oscillation of the pistons is caused, in this invention, by the oscillation of the gearboxes in centripetal reaction to the rotation of the eccentrics. The motion of the gearboxes, which are fixed by straight shafts to the pistons, is always collinear with the motion of the pistons. There are no connecting rods that, in addition to moving to and fro within the cylinder, also move from side to side in relation to the cylinder walls. Thus it is a principal object of this invention to reduce friction, heat and wear between the piston and the cylinder and improve pump efficiency.

Further, the eccentrics provide increased pressure on the liquid in the cylinder in direct response to any increases in the back pressure against the discharged liquid. Any pulsation in forces due to variations in pumping effort are therefore only transmitted as far back as the gearboxes and are absorbed by the eccentrics rather than being transmitted all the way back to the gear train and outside power source. Thus it is another object of the invention to reduce stress on the power train of the device.

Still further, the eccentrics provide inertial mass to the extent desired to smooth load on the motor without having to add a flywheel. Thus it is another object of the invention to simplify the construction of a reciprocating pump.

DETAILED DESCRIPTION OF INVENTION

Figure 1:
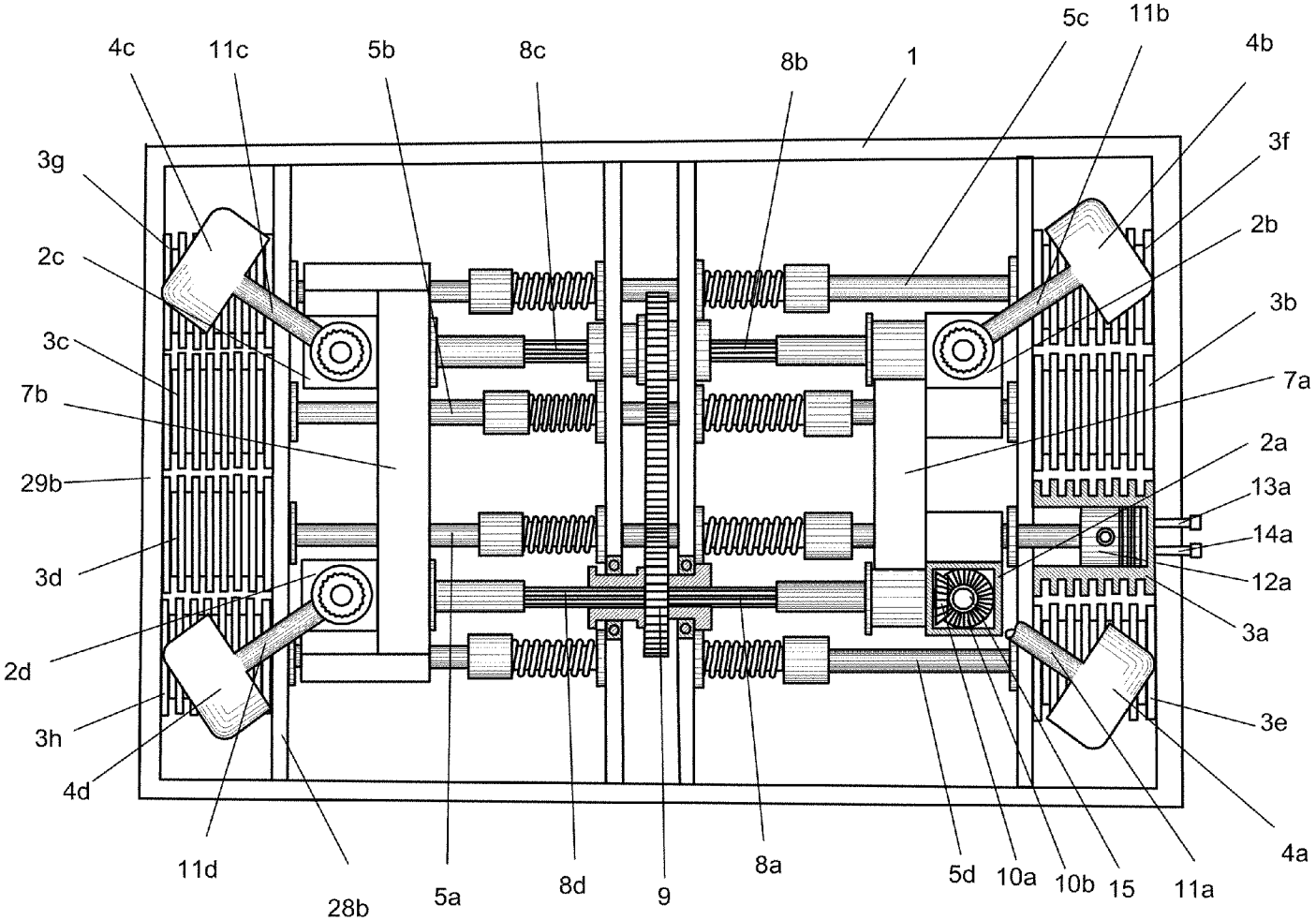
FIG. 1 is a top view of the apparatus.

Referring now to the drawings, in which like reference characters in the several figures represent like elements in all the figures, the centripetally-powered reciprocating pump is constructed and assembled as follows:

FIG. 1 is a top view of the apparatus, showing the complete unit less the drive motor. It principally comprises a case 1 with four gearboxes 2*a-d*, eight cylinders 3*a-h*, eight eccentrics 4*a-h* (only four of which, 4*a-d*, are visible in this view). four piston rods 5*a-d*, eight pistons 12*a-h* (only one, 12*a*, visible in a cutaway of cylinder 3*a* here, the remainder within cylinders 3*b-h*), and four splined shafts 8*a-d*. The splined shafts 8 are rotated by a centrally-mounted gear train 9 driven by a motor (omitted for clarity). The splined shafts 8 in turn rotate bevel gears (see, e.g., 10*a* and 10*b* in the cutaway of gearbox 2*a*) in the gearboxes 2, which in turn swing the eccentrics 4 around.

The gearboxes consist of three-shaft construction. The splined input shaft 8 to each gearbox turns an input bevel gear 10*a* within the gearbox (see cutaway) which in turn drives two output bevel gears at right angles to the input bevel gear (only output bevel gear 10*b* is visible in the cutaway). The output gears then drive short upper and lower shafts at right angles to the input shaft (only lower shaft 15 is visible in the cutaway). Two eccentric masses are attached to the upper and lower shafts respectively, which rotate in the same plane as the output bevel gears in the gearbox.

The centripetal force of the gearboxes 2 in reaction to the rotating eccentrics 4 along their arms 11*a-d* as they rotate pulls the gearboxes right and left horizontally in this view. The gearboxes are affixed to the piston rods 5 by tie plates 7*a-b*, so that the gearboxes drive the piston rods right and left. The piston rods 5 push and pull the pistons 12, drawing fluid into cylinders 3 through inlet valves 13 and pumping it out through outlet valves 14 (13*a* and 14*a* shown).

One of the four gearboxes, 2*a*, and one of the eight cylinders, 3*a*, are shown in cutaway. The right-hand pair of gearboxes 2*a* and 2*b* are paired and joined together with tie plate 7*a* so that they oscillate together horizontally in this view. The piston rods 5*a* and 5*b* are also affixed to the tie plate 7*a* so that as the gearboxes 2*a* and 2*b* oscillate, the piston rods 5*a* and 5*b* move with them. The left-hand end also has paired gearboxes timed with the same motion. The two sets of paired gearboxes are timed to oscillate toward and away from each other horizontally, simultaneously, as the eccentrics rotate. This assures that the horizontal motion of mass is balanced so that the entire apparatus does not experience horizontal vibration. The right-hand pair of eccentrics 4*a* and 4*b* counter-rotate with respect to each other, as does the left-hand pair 4*c* and 4*d*, so that the vertical and horizontal vibrational components of their motion also cancel out. It is well to note in addition that the pairs of eccentrics are offset on their respective output shafts in the plane of view so that their planes of rotation do not intersect, thereby making sure they do not collide.

Thus, to summarize the motion of one-half of the total moving parts in this view, gear train 9 turns splined shafts 8*a* and 8*b*, which, through bevel gears 10, cause eccentrics 4*a* and 4*b* to rotate. This rotation drives gearboxes 2*a* and 2*b* to and fro horizontally, which, through tie plate 7*a*, drives 115 piston rods 5*a* and 5*b* to and fro. This in turn causes pistons 12*a* etc. within cylinders 3*a-d* to reciprocate and pump fluid.

Figure 2:
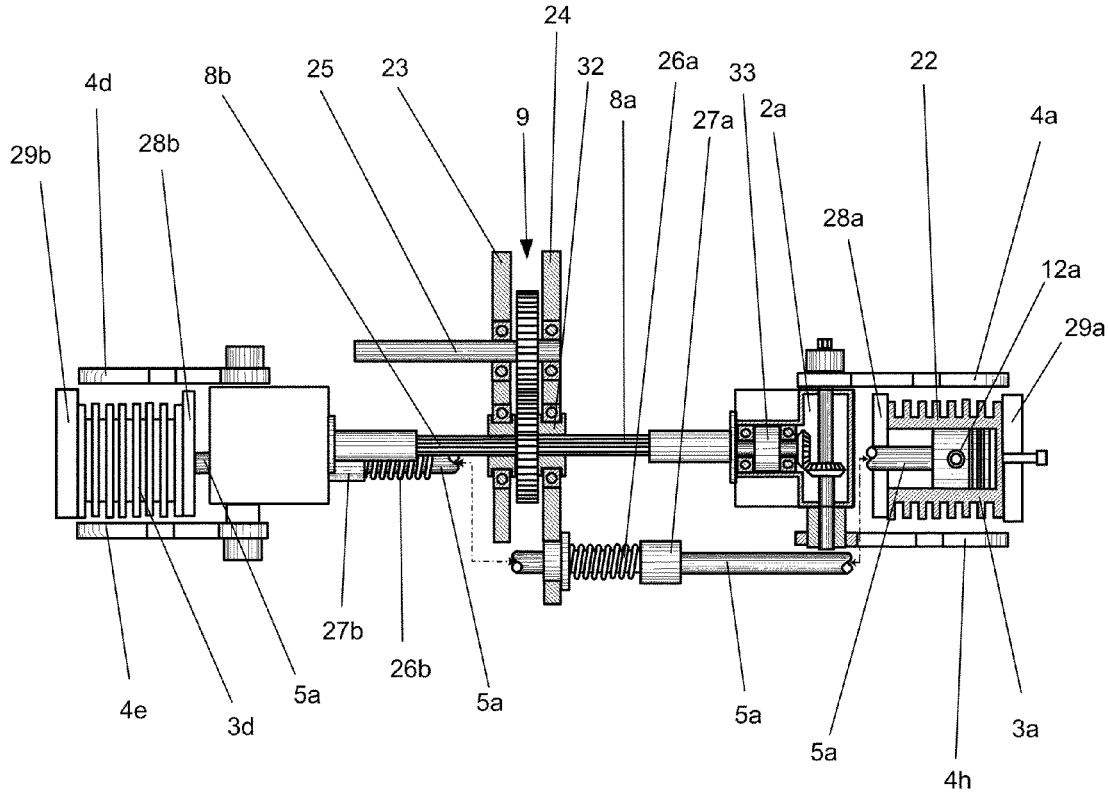
FIG. 2 is a side view of the apparatus.

FIG. 2 is a side view of the apparatus, that is, as seen from the right in FIG. 1, with some cutaway views. The right side of this figure shows a cutaway of cylinder 3*a*, rendering piston 12*a* visible, driven by piston rod 5*a*. The cylinder 3*a* has a pressed-fit cast iron sleeve 20 into an aluminum 120 sleeve 21. This aluminum sleeve 21 further comprises cooling fins 22 that are machined into it for dissipation of heat. The inner end of each cylinder, through which the piston rods pass, is defined by interior plates 28*a-b*. (Only piston rod 5*a* is shown here.) The outer end of each cylinder to which the valves are attached is defined by exterior plates 29*a-b*.

The piston rod 5*a* is shown in broken view to better illustrate other parts.

In this view, not only are eccentrics 4*a* and 4*d* (of FIG. 1) visible, but also cooperating eccentrics 4*e* and 4*h* can be seen on the underside of the apparatus. A cutaway of a gearbox 2*a* shows the interior of the gearbox. The gearboxes are driven by splined shafts 8*a* and 8*b*, which oscillate left and right along with the gearboxes. The end of each splined shaft farthest from the gear train 9 drives a gearbox to and fro, and rotates about its axis within a thrust bearing 33 at the gearbox. Thrust bearing 33 is capable of withstanding oscillating thrust in either direction. Each splined shaft is supported near its other end at gear train 9 by passing through a ball nut 32 mounted in bulkhead 24, which allows the splined shaft to turn as well as oscillate right and left within it. There is enough room between left splined shaft 8*a* and right splined shaft 8*b* to allow them to oscillate in opposite directions without interference. Alternatively, the axes of the splined shafts may be offset slightly to keep them from colliding.

In this drawing, cylinder 3*a* is the cutaway cylinder at right. Piston 12*a* within it, and piston 12*d* (hidden within cylinder 3*d* at left) move together by being fixed to either end of piston rod 5*a*. The piston rods in the apparatus are further equipped with return springs, such as 26*a-b* shown here. These springs return the pistons to the center of their stroke, and are set by collars 27*a-b* in whatever 140 degree of compression is necessary to prevent the pistons from bottoming or topping out during their cycle.

The invention as described thus far has eight rotating eccentrics (four above the apparatus in FIG. 2 and four below). Having four eccentrics above and four below allows further vibration reduction because the offset in the planes of rotation of the eccentrics above can thereby be matched by offsets 145 in the planes of rotation below. Notwithstanding these vibration damping measures, it should be evident that an embodiment of the invention can be made utilizing one eccentric to drive one gearbox, in turn reciprocating one piston. Vibration may not be an issue, or other means (such as an elastic suspension) may be utilized to damp vibration. Similarly, any number of eccentrics can be used to drive any number of pistons within the scope of this invention so long as each embodiment comprises the key feature of using a rotating weight to cause a gearbox to oscillate and drive a piston.

Figure 3:
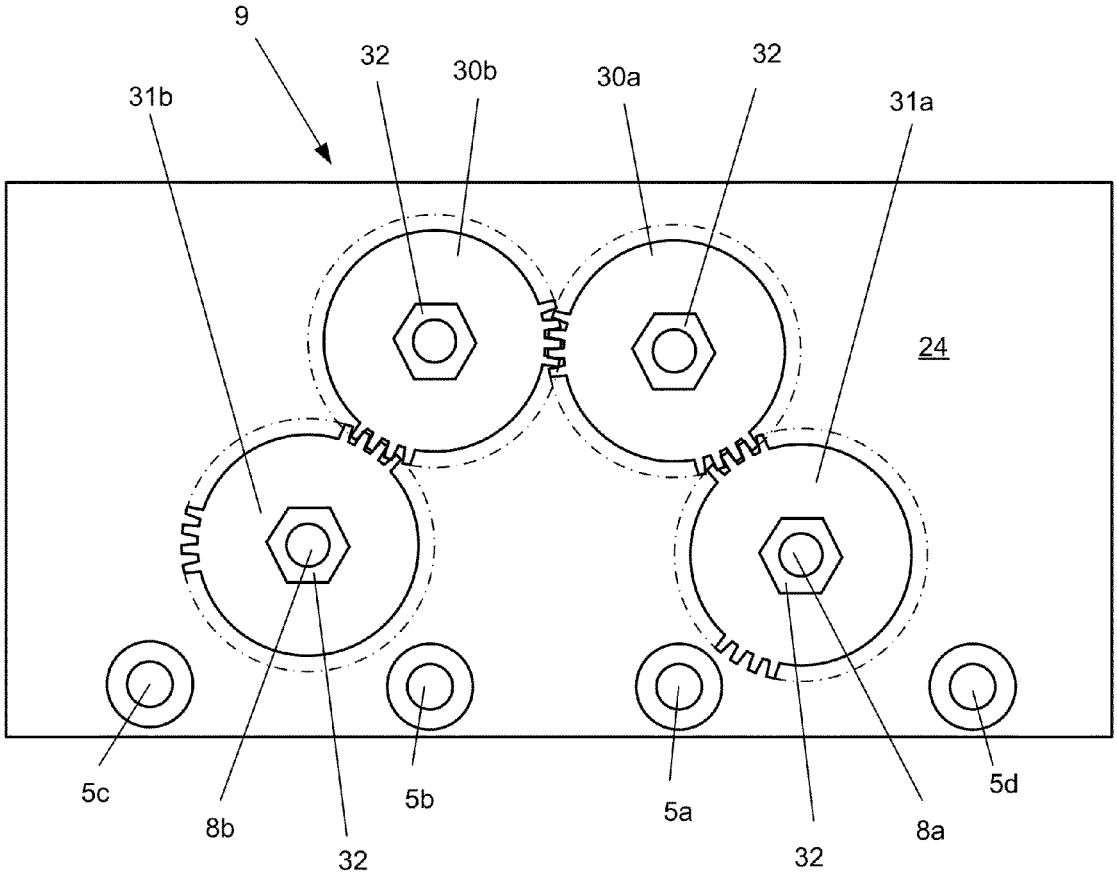
FIG. 3 is a front view of the drive gear train.

FIG. 3 is a front view of the drive gear train 9, that is, as seen from the bottom of the drawing in FIG. 1. Either or both of the upper gears 30*a* or 30*b* may be driven by a motor, and in turn drive lower gears 31*a-b*. which in turn drive splined shafts 8*a-b*. Piston rods 5*a-d* can be seen passing through bulkhead 24.

Figure 4:
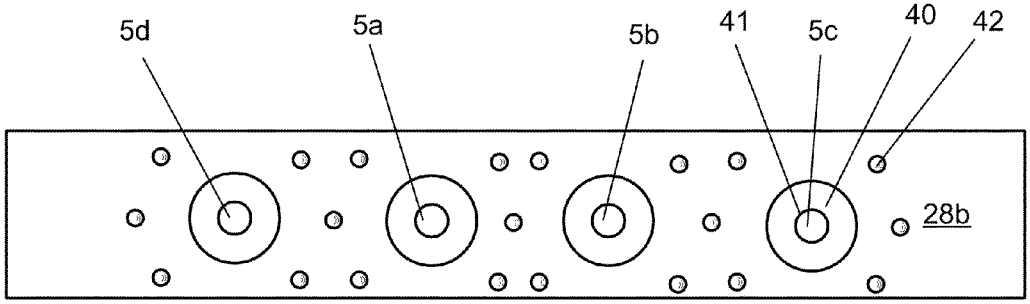
FIG. 4 is a rear view of an interior plate.

FIG. 4 is a rear view of one of the two interior plates, 28*b*, that is, a view of the plate as seen from the left in FIG. 2. In this figure are shown cast iron bushings 40 with seals 41 through which the piston rods 5*a-d* go into the cylinders. Also seen are the ends of bolts 42 which clamp the cylinders (not shown in this view) between this plate and exterior plate 29*b* (see FIG. 7).

Figure 5:
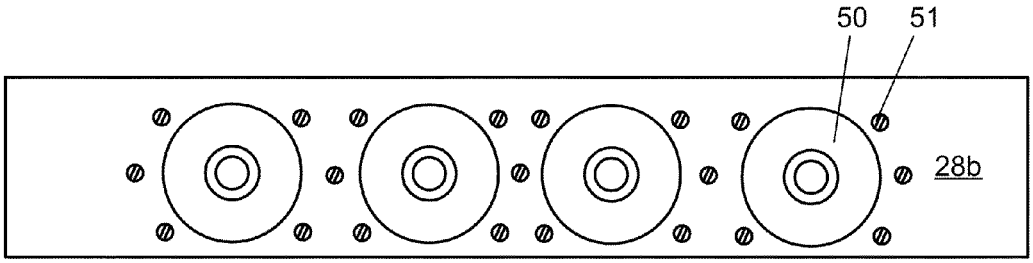
FIG. 5 is a front view of an interior plate.

FIG. 5 is a front view of interior plate 28*b*. This is the side of the plate facing cylinders 3*g*, 3*c*, 3*d*, and 3*h* in FIG. 1. The plate is machined with four circular indentations 50 of approximately one-eighth inch depth to accommodate and seal the cylinders, and with holes 51 for bolts.

Figure 6:
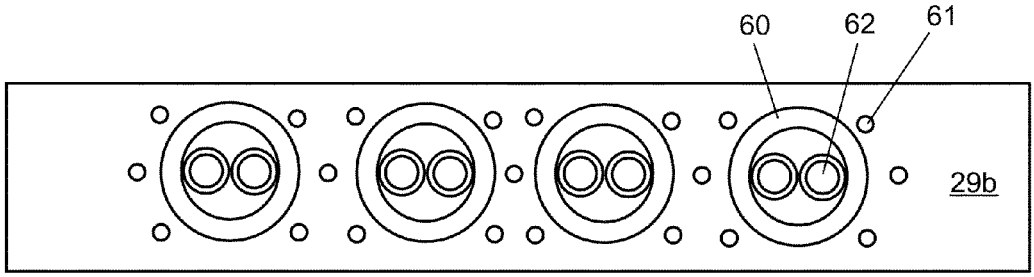
FIG. 6 is a rear view of an exterior plate.

FIG. 6 is a rear view of one of the two exterior plates, 29*b*, that is, the side of the plate facing the cylinders. It too is machined with indentations 60 of approximately one-eighth inch depth. It also shows bolt holes 61 and borings 62 to accommodate valves and hydraulic fittings.

Figure 7:
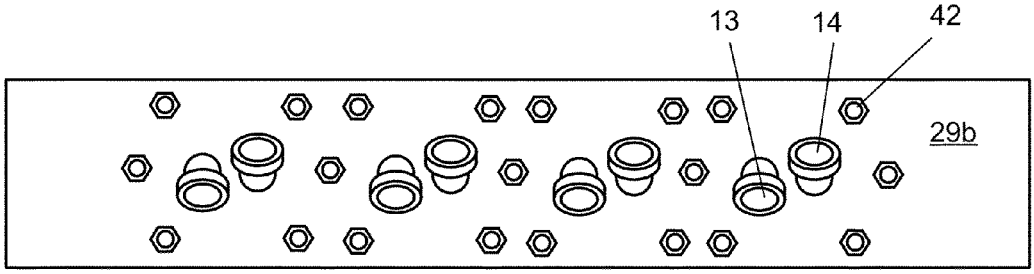
FIG. 7 is a front view of an exterior plate.

FIG. 7 is a front view of exterior plate 29*b*. It shows hydraulic fittings that employ check valves, exemplified by inlet valve 13 and outlet valve 14, which direct fluid or gas to and away from the cylinders. Also shown are the heads of clamping bolts 42.

The check valves 14 serving as outlets from each cylinder are directed to a supply tank, pressure tank, and/or manifold (not shown). This pressure supply can be directed to hydraulic motors or into a turbine, to achieve rotary power from bidirectional centripetal force.

The invention claimed is:

1. A centripetally-powered reciprocating pump, comprising:

at least one piston reciprocating within a cylinder;

the at least one piston being driven by a piston rod;

the piston rod having a first end, an intermediate portion, and a second end, the at least one piston being fixed to the first end of the piston rod;

the cylinder comprising intake and outlet valves to take in low pressure fluid when the at least one piston is moved in a first direction and expel high pressure fluid when the at least one piston is moved in a second direction;

the piston rod being driven by a gearbox, the gearbox being held in a fixed relation to the intermediate portion;

the gearbox containing at least one driven gear;

the at least one driven gear driving a shaft mounted in a bearing in the wall of the gearbox;

the shaft being oriented substantially perpendicular to the piston rod;

the shaft having an inner end and an outer end, the at least one driven gear being fixed to the inner end;

the gearbox containing a drive gear rotationally engaging the at least one driven gear; and an eccentric mass fixed to the outer end of the shaft, so that when the drive gear is made to rotate, the driven gear turns the eccentric mass, the eccentric mass exerts a reciprocating force on the gearbox, the gearbox exerts a reciprocating force on the piston rod, and the piston rod exerts a reciprocating force on the at least one piston.

2. A centripetally-powered reciprocating pump, comprising:

at least one vertical shaft having an upper end, a first vertical axis, and a lower end;

a rigid, shaped mass fixed to the upper end so that the center of gravity is displaced eccentrically from the first vertical axis of the at least one vertical shaft and so that the shaped mass rotates about the first vertical axis in a horizontal plane;

a gearbox comprising an upper surface and a side surface;

the at least one vertical shaft passing through an upper bearing in the upper surface and having a first gear fixed to the lower end of the at least one vertical shaft within the gearbox;

a horizontal shaft comprising a right end, a left end, and a horizontal axis;

the right end passing through a side bearing in the side surface and having a second gear fixed to the right end within the gearbox;

the right end held rotatably within the gearbox so that the right end and the gearbox move together;

the second gear being rotatably engaged to the first gear;

a casing;

a driven gear mounted in the casing for rotation in a vertical plane fixed in relation to the casing;

the horizontal shaft slidably mounted through the center of the driven gear so as to permit oscillation of the horizontal shaft left and right;

the horizontal shaft being slidably engaged to the driven gear so that the driven gear turns the horizontal shaft about the horizontal axis;

a rigid tie fixed to the gearbox;

a horizontal piston rod fixed to the rigid tie and slidably mounted within the casing to move left and right;

at least one piston fixed to one end of the horizontal piston rod; and at least one cylinder fixed to the casing, within which the at least one piston can oscillate;

the at least one cylinder comprising intake and discharge valves that pump fluid when the piston oscillates.

3. A centripetally-powered reciprocating pump, comprising:

a. a first vertical shaft having a upper end, a vertical axis, and a lower end;

a first rigid, shaped mass fixed to the upper end so that its center of gravity is displaced eccentrically along a first line extending from the vertical axis and so that the first shaped mass rotates about the vertical axis in a horizontal plane;

a first gearbox comprising a upper surface, a lower surface, and a side surface;

the first vertical shaft passing through an upper bearing in the upper surface of the first gearbox and having a first lower gear fixed to the lower end of the first vertical shaft within the first gearbox;

a first horizontal splined shaft comprising a right end and a left end;

the right end of the first horizontal splined shaft passing through a side bearing in the side surface of the first gearbox and having a first right gear fixed to the first right end;

the first lower gear being rotatably engaged to the first right gear;

the horizontal angle between the first line and the axis of the first horizontal splined shaft being a value V1;

a casing;

a first driven gear mounted in the casing for rotation in a vertical plane;

a first ball nut fixed to the center of the first driven gear;

the first horizontal splined shaft slidably mounted within the first ball nut so as to permit oscillation of the first horizontal splined shaft left and right;

a second driven gear mounted in the casing for rotation in a vertical plane;

a second ball nut fixed to the center of the first driven gear;

a second horizontal splined shaft slidably mounted within a second ball nut so as to permit oscillation of the second horizontal splined shaft left and right;

a first rigid tie being affixed to the first gearbox;

a first horizontal piston rod fixed to the first rigid tie and having a left end and a right end and being slidably mounted within the casing to move left and right;

a first piston fixed to the right end of the first horizontal piston rod;

a first cylinder fixed to the casing, within which the first piston can oscillate;

the first cylinder comprising intake and discharge valves that pump fluid when the piston oscillates;

a second piston fixed to the left end of the first horizontal piston rod;

a second cylinder fixed to the casing, within which the second piston can oscillate;

the second cylinder comprising intake and discharge valves that pump fluid when the piston oscillates;

a second horizontal piston rod fixed to the first rigid tie and having a left end and a right end and being slidably mounted within the casing to move left and right;

a third piston fixed to the right end of the second horizontal piston rod;

a third cylinder fixed to the casing, within which the third piston can oscillate;

the third cylinder comprising intake and discharge valves that pump fluid when the piston oscillates;

a fourth piston fixed to the left end of the second horizontal piston rod;

a fourth cylinder fixed to the casing, within which the fourth piston can oscillate;

the fourth cylinder comprising intake and discharge valves that pump fluid when the piston oscillates;

b. a second vertical shaft having a upper end, a vertical axis, and a lower end;

a second rigid, shaped mass fixed to the upper end so that its center of gravity is displaced eccentrically along a second line extending from the vertical axis and so that the second shaped mass rotates about the vertical axis in a horizontal plane;

a second gearbox comprising a upper surface, a lower surface, and a side surface;

the second vertical shaft passing through an upper bearing in the upper surface of the second gearbox and having a second lower gear fixed to the lower end of the second vertical shaft within the second gearbox;

a second rigid tie being affixed to the second gearbox;

the left end of the first horizontal splined shaft passing through a side bearing in the side surface of the second gearbox and having a first left gear fixed to the left end;

the second lower gear being rotatably engaged to the first left gear;

the horizontal angle between the second line and the axis of the first horizontal splined shaft being a value V2;

c. a third vertical shaft having a upper end, a vertical axis, and a lower end;

a third rigid, shaped mass fixed to the upper end so that its center of gravity is displaced eccentrically along a third line extending from the vertical axis and so that the third shaped mass rotates about the vertical axis in a horizontal plane;

a third gearbox comprising a upper surface, a lower surface, and a side surface;

the third vertical shaft passing through an upper bearing in the upper surface of the third gearbox and having a third lower gear fixed to the lower end of the third vertical shaft within the third gearbox;

the third gearbox being affixed to the first rigid tie;

the right end of the second horizontal splined shaft passing through a side bearing in the side surface of the third gearbox and having a second right gear fixed to the right end;

the third lower gear being rotatably engaged to the second right gear;

the horizontal angle between the third line and the axis of the second horizontal splined shaft being a value V3;

a third horizontal piston rod fixed to the second rigid tie and having a left end and a right end and being slidably mounted within the casing to move left and right;

a fifth piston fixed to the right end of the third horizontal piston rod;

a fifth cylinder fixed to the casing, within which the fifth piston can oscillate;

the fifth cylinder comprising intake and discharge valves that pump fluid when the piston oscillates;

a sixth piston fixed to the left end of the third horizontal piston rod;

a sixth cylinder fixed to the casing, within which the sixth piston can oscillate;

the sixth cylinder comprising intake and discharge valves that pump fluid when the piston oscillates;

a fourth horizontal piston rod fixed to the second rigid tie and having a left end and a right end and being slidably mounted within the casing to move left and right;

a seventh piston fixed to the right end of the fourth horizontal piston rod;

a seventh cylinder fixed to the casing, within which the seventh piston can oscillate;

the seventh cylinder comprising intake and discharge valves that pump fluid when the piston oscillates;

an eighth piston fixed to the left end of the fourth horizontal piston rod;

an eighth cylinder fixed to the casing, within which the eighth piston can oscillate;

the eighth cylinder comprising intake and discharge valves that pump fluid when the piston oscillates;

d. a fourth vertical shaft having a upper end, a vertical axis, and a lower end;

a fourth rigid, shaped mass fixed to the upper end so that its center of gravity is displaced eccentrically along a fourth line extending from the vertical axis and so that the fourth shaped mass rotates about the vertical axis in a horizontal plane;

a fourth gearbox comprising a upper surface, a lower surface, and a side surface;

the fourth vertical shaft passing through an upper bearing in the upper surface of the fourth gearbox and having a fourth lower gear fixed to the lower end of the fourth vertical shaft within the fourth gearbox;

the fourth gearbox being affixed to the second rigid tie;

the left end of the second horizontal splined shaft passing through a side bearing in the side surface of the fourth gearbox and having a second left gear fixed to the left end of the second horizontal splined shaft;

the fourth lower gear being rotatably engaged to the second left gear;

the horizontal angle between the fourth line and the axis of the second horizontal splined shaft being a value V4;

e. a fifth vertical shaft having a upper end, a vertical axis, and a lower end;

a fifth rigid, shaped mass fixed to the lower end so that its center of gravity is displaced eccentrically along a fifth line extending from the vertical axis and so that the fifth shaped mass rotates about the vertical axis in a horizontal plane;

the fifth vertical shaft passing through a lower bearing in the lower surface of the first gearbox and having a first upper gear fixed to the upper end of the fifth vertical shaft within the first gearbox;

the first upper gear being rotatably engaged to the first right gear;

the horizontal angle between the fifth line and the axis of the first horizontal splined shaft being the value V1;

f. a sixth vertical shaft having a upper end, a vertical axis, and a lower end;

a sixth rigid, shaped mass fixed to the lower end so that its center of gravity is displaced eccentrically along a sixth line extending from the vertical axis and so that the sixth shaped mass rotates about the vertical axis in a horizontal plane;

the sixth vertical shaft passing through a lower bearing in the lower surface of the second gearbox and having a second upper gear fixed to the upper end of the sixth vertical shaft within the second gearbox;

the second upper gear being rotatably engaged to the first left gear;

the horizontal angle between the sixth line and the axis of the first horizontal splined shaft being the value V2;

g. a seventh vertical shaft having a upper end, a vertical axis, and a lower end;

a seventh rigid, shaped mass fixed to the lower end so that its center of gravity is displaced eccentrically along a seventh line extending from the vertical axis and so that the seventh shaped mass rotates about the vertical axis in a horizontal plane;

the seventh vertical shaft passing through a lower bearing in the lower surface of the third gearbox and having a third upper gear fixed to the upper end of the seventh vertical shaft within the third gearbox;

the third upper gear being rotatably engaged to the second right gear;

the horizontal angle between the seventh line and the axis of the second horizontal splined shaft being the value V3;

h. an eighth vertical shaft having a upper end, a vertical axis, and a lower end;

an eighth rigid, shaped mass fixed to the lower end so that its center of gravity is displaced eccentrically along an eighth line extending from the vertical axis and so that the eighth shaped mass rotates about the vertical axis in a horizontal plane;

the eighth vertical shaft passing through a lower bearing in the lower surface of the fourth gearbox and having a fourth upper gear fixed to the upper end of the eighth vertical shaft within the fourth gearbox;

the fourth upper gear being rotatably engaged to the second left gear;

the horizontal angle between the eighth line and the axis of the second horizontal splined shaft being the value V4; and the first and second driven gears being driven by a common prime mover.

4. The pump of claim 3, in which:

said first and second driven gears turn oppositely;

the masses of all eight of said rigid, shaped masses equal each other; and when the pistons are all set at top dead center in the cylinders;

V2 equals the negative of V1;

V3 equals V1 plus 180 degrees; and

V4 equals V2 plus 180 degrees.

5. The pump of claim 4, in which:

V1 is in the range of 80 to 170 degrees.

6. The pump of claim 4, in which:

V1 is in the range of 90 to 150 degrees.

7. The pump of claim 4, in which:

V1 is in the range of 100 to 130 degrees.

8. The pump of claim 4, in which:

said piston rods further comprise means for limiting extreme left and right movements of the pistons.

9. The pump of claim 4, in which:

travel of said pistons toward bottom dead center of the cylinders is assisted by biasing means on said piston rods.

10. The pump of claim 9, in which:

said first and second driven gears rotate in a central vertical plane;

said casing further comprises a right vertical baffle to the right of the central vertical plane, and a left vertical baffle to the left of the central vertical plane;

the central vertical plane being halfway between the first and second vertical planes;

said cylinders are of identical shape, having substantially flat vertical internal bottom surfaces;

the bottom vertical surfaces of said first, third, fifth, and seventh cylinders lie in a right vertical plane;

the bottom vertical surfaces of said second, fourth, sixth, and eighth cylinders lie in a left vertical plane;

the central vertical plane is equidistant between the right and left vertical planes; and said biasing means comprises a right helical spring positioned on each of said piston rods to the right of the right vertical baffle;

a right collar fixed to each of said piston rods to the right of each right helical spring;

a left helical spring positioned on each of said piston rods to the left of the left vertical baffle;

a left collar fixed to each of said piston rods to the left of each left helical spring;

the helical springs being compressed between the collars and the vertical baffles.

11. The pump of claim 3, in which:

said shaped masses are shaped as airfoils to induce flow of air through the pump.

12. The pump of claim 3, in which:

said prime mover is at least one electric motor mounted on said casing.

13. The pump of claim 3, in which:

said fluid is hydraulic fluid output to a hydraulic motor.

14. A centripetally-powered reciprocating pump, comprising:

a piston rod having a first end, and intermediate section, and a second end;

a piston fixed to the first end;

a cylinder having a closed bottom and a top through which the piston rod extends and in which the piston can reciprocate;

the cylinder having at least one intake valve allowing fluid to enter the cylinder when the piston is moving away from the closed bottom, and at least one output valve allowing fluid to leave the cylinder when the piston is moving towards the closed bottom;

a rotor shaft mounted substantially perpendicularly to the piston rod;

the rotor shaft having a proximal end, an axis, and a distal end;

a shaped mass fixed to the distal end eccentrically to the axis;

means for rotating the rotor shaft so as to swing the shaped mass about the axis, thereby applying a force on the rotor shaft perpendicular to the axis, the force revolving about the axis in synchrony with the shaped mass; and means for transmitting the force from the rotor shaft to the piston rod;

said means for transmitting the force from the rotor shaft to the piston rod comprises a rigid tie fixed to the piston rod;

a gearbox fixed to the rigid tie; and a bearing in a first wall of the gearbox through which said proximal end of said rotor shaft projects.

15. The pump of claim 14, in which:

said means for rotating the rotor shaft comprises a splined shaft mounted substantially parallel to said piston rod having a first splined shaft end and a second splined shaft end;

the second splined shaft end projecting through a bearing in a second wall of said gearbox; and a means for rotating the first splined shaft end; and means for transmitting rotation of the second splined shaft end to said rotor shaft.

16. The pump of claim 15, in which:

said means for rotating said first splined shaft end is a gear train turned by a prime mover; and said means for transmitting rotation of said second splined shaft end to said rotor shaft is a first bevel gear fixed to said second splined shaft end engaged, within said gearbox, with a second bevel gear fixed to said rotor shaft.

17. The pump of claim 16, in which:

the center of mass of said shaped mass is positioned on said distal end of said rotor shaft so that the resultant of the velocity vector of the center of mass in the direction toward said closed bottom is at a maximum when the piston is decelerating in its travel toward said closed bottom.

* * * * *